US010575566B2

(12) United States Patent
Cain

(10) Patent No.: US 10,575,566 B2
(45) Date of Patent: Mar. 3, 2020

(54) GARMENT

(71) Applicant: STRETCHLINE INTELLECTUAL PROPERTIES LIMITED, Tortola (VG)

(72) Inventor: Miles Stephen Cain, Derbyshire (GB)

(73) Assignee: Stretchline Intellectual Properties Limited, Tortola (VG)

( * ) Notice: Subject to any disclaimer, the term of this patent is extended or adjusted under 35 U.S.C. 154(b) by 0 days.

(21) Appl. No.: 15/778,953

(22) PCT Filed: Nov. 23, 2016

(86) PCT No.: PCT/GB2016/053681
§ 371 (c)(1),
(2) Date: May 24, 2018

(87) PCT Pub. No.: WO2017/089799
PCT Pub. Date: Jun. 1, 2017

(65) Prior Publication Data

US 2018/0352871 A1 Dec. 13, 2018

(30) Foreign Application Priority Data

Nov. 25, 2015 (GB) ..... 1520813.5

(51) Int. Cl.
*A41B 11/00* (2006.01)
*A41D 19/015* (2006.01)

(52) U.S. Cl.
CPC ..... *A41B 11/008* (2013.01); *A41D 19/01558* (2013.01); *A41B 2400/80* (2013.01);
(Continued)

(58) Field of Classification Search
CPC ..... A41B 11/008; A41B 11/007; A41B 19/01558; D04B 1/26; D04B 1/265
See application file for complete search history.

(56) References Cited

U.S. PATENT DOCUMENTS 4,021,860 A * 5/1977 Swallow ..... A41B 11/008 2/239
4,104,892 A * 8/1978 Thorneburg ..... A41B 11/02 2/239

(Continued)

FOREIGN PATENT DOCUMENTS

CN 2227424 5/1996
EP 0 966 891 12/1999

(Continued)

OTHER PUBLICATIONS

International Search Report and Written Opinion, PCT/GB2016/053681, Stretchline Intellectual Properties Limited, 8 pages (dated Feb. 8, 2017).

(Continued)

*Primary Examiner* — Danny Worrell
(74) *Attorney, Agent, or Firm* — Foley and Lardner LLP

(57) ABSTRACT

A garment (10) comprising a grip coating located on inner and outer surfaces of a garment section (12) so as to generate in use friction between a wearer's skin and the garment (10) and friction between the garment (10) and an external contact surface. The grip coating includes a first array of grip elements (14) located on the inner surface of the garment section (12) and a second array of grip elements (16) located on the outer surface of the garment section (12). The first and second arrays are arranged relative to each other so that the grip elements (14,16) of the first and second arrays are offset relative to each other and do not overlie or overlap each other.

17 Claims, 2 Drawing Sheets

(52) U.S. Cl.
CPC ..... *A41B 2400/82* (2013.01); *A41D 2400/80* (2013.01); *A41D 2400/82* (2013.01)

(56) References Cited

U.S. PATENT DOCUMENTS

| | | | | | |
|---|---|---|---|---|---|
| 4,149,274 | A * | 4/1979 | Garrou | A41B 11/008 | 2/239 |
| 4,651,354 | A * | 3/1987 | Petrey | A41B 11/004 | 2/239 |
| 4,728,538 | A * | 3/1988 | Kaspar | D06M 17/06 | 118/202 |
| 5,412,957 | A * | 5/1995 | Bradberry | A61F 13/08 | 2/239 |
| 5,708,985 | A * | 1/1998 | Ogden | A41B 11/02 | 2/239 |
| 6,138,281 | A * | 10/2000 | Chiaruttini | A41B 11/00 | 2/239 |
| 6,314,584 | B1 * | 11/2001 | Errera | A41B 11/008 | 2/239 |
| 6,378,139 | B1 * | 4/2002 | Mazzaglia | A41B 11/008 | 2/242 |
| 6,708,342 | B2 * | 3/2004 | Boersema | A41B 11/008 | 2/69 |
| 7,346,935 | B1 * | 3/2008 | Patterson | A41B 11/004 | 2/239 |
| 8,220,077 | B1 * | 7/2012 | Ott | A41B 11/008 | 2/239 |
| 9,301,552 | B2 * | 4/2016 | Dickson | A41B 11/008 | |
| D794,317 | S * | 8/2017 | Stewart | D2/954 | |
| 2002/0000003 | A1 * | 1/2002 | Boersema | A41B 11/008 | 2/239 |
| 2003/0074718 | A1 * | 4/2003 | English | A41B 11/004 | 2/239 |
| 2004/0221371 | A1 * | 11/2004 | Kato | A41B 11/008 | 2/239 |
| 2005/0091729 | A1 * | 5/2005 | Alley | A41B 11/004 | 2/239 |
| 2005/0120463 | A1 * | 6/2005 | Cacioppo | A41B 11/008 | 2/239 |
| 2005/0144703 | A1 * | 7/2005 | Hilbert | A41B 11/008 | 2/239 |
| 2014/0026285 | A1 | 1/2014 | Baldino | | |
| 2014/0223630 | A1 | 8/2014 | Johnson | | |
| 2014/0283289 | A1 | 9/2014 | Hawkins | | |

FOREIGN PATENT DOCUMENTS

| | | |
|---|---|---|
| WO | WO 2012/138569 A1 | 10/2012 |
| WO | WO 2017/085514 | 5/2017 |

OTHER PUBLICATIONS

United Kingdom Search Report, App. No. 1520813.5, 2 pages (dated Mar. 17, 2016).

Australian Examination Report No. 1, App. No. 2016358440, 3 pages (dated Sep. 6, 2018).

Chinese Office Action and English-Language Translation, App. No. 201680077434.9, 19 pages (dated Apr. 28, 2019).

European Third Party Observations, App. No. 16813115.9, 7 pages (dated Nov. 28, 2018).

European Office Action, App. No. 16813155.0, 5 pages (dated Apr. 18, 2019).

"SHEEC SoleHugger Secret", retrieved from https://www.amazon.co/uk/Ultra-Show-Slip-Womens-Cotton/dp/B008NDKREU?th=1&psc=1, 12 pages (Oct. 19, 2014).

* cited by examiner

GARMENT

CROSS-REFERENCE TO RELATED APPLICATIONS

This application is a U.S. national stage of PCT/GB2016/053681, filed Nov. 23, 2016, which claims the benefit of and priority to Great Britain Patent Application No. 1520813.5, filed Nov. 25, 2015, both of which are incorporated herein by reference in their entireties.

BACKGROUND

The invention relates to a garment having a grip coating located on inner and outer surfaces of a garment section and, in a particular embodiment, relates to a sock or glove having a grip coating located on inner and outer surfaces of sole or palm portions thereof.

SUMMARY

According to an aspect of the invention there is a provided a garment comprising a grip coating located on inner and outer surfaces of a garment section so as to generate in use friction between a wearer's skin and the garment and friction between the garment and an external contact surface, the grip coating including a first array of grip elements located on the inner surface of the garment section and a second array of grip elements located on the outer surface of the garment section, the first and second arrays being arranged relative to each other so that the grip elements of the first and second arrays are offset relative to each other and do not overlie or overlap each other.

The provision of grip elements on the inner and outer surfaces of a garment section, so as to generate friction between a wearer's skin and the garment and friction between the garment and an external contact surface, reduces relative movement between the wearer, the garment and the external contact surface. Accordingly it reduces the creation of sweat on the wearer's skin and reduces the risk of irritation that could otherwise be caused as a result.

It is envisaged that the external contact surface might, for example, be the inner surface of another, outer garment, the inner surface of a shoe, the outer surface of a tennis racket or golf club grip.

Locating the grip elements of the first and second arrays so as to be offset relative to each other and to not overlie or overlap each other improves the level of comfort offered by the grip elements.

The provision of grip elements on the garment section will ultimately be felt by a wearer when the garment is worn, and could lead to discomfort. Any overlap between the grip elements accentuates the presence of the grip elements by creating a more bulky mass between a wearer's skin and the external contact surface. This would accentuate any discomfort caused by the presence of the grip elements.

In addition, arranging the first and second arrays of grip elements so as to be offset relative to each other, further increases the comfort of the wearer when the garment is worn by creating a bed of grip elements that produce a more uniform sensation for the wearer.

In particularly preferred embodiments, the garment may be a sock or a glove or the like and the grip coating may be located on inner and outer surfaces of sole or palm portions of the garment. In such embodiments the first array of grip elements are located on the inner surface of the sole or palm portion and the second array of grip elements are located on the outer surface of the sole or palm portion.

Whilst socks and gloves are identified as particular embodiments of the invention, it is envisaged that the garment may take many other forms of apparel. The garment could, for example, take the form of a piece of performance apparel such as a base layer. In such embodiments the grip coating might be located, for example, on an inner arm section of the garment or an inner thigh section of the garment so as to reduce relative movement between the wearer's skin, the garment and an external contact surface such as a piece of exercise or sports equipment or an inner surface of an outer garment layer.

It is envisaged that the provision of grip elements need not be limited to one garment section and the first and second arrays of grip elements could extend across the inner and outer surfaces respectively of more than one garment section. For example, in the case of socks or gloves, the grip elements need not be limited to the sole or palm portions thereof. The grip elements may, for example, be provided on inner and outer surfaces of the garment so as to effectively cover the entire surface of the garment and thereby extend about a wearer's hand or foot so as to reduce or prevent relative movement between the wearer's skin, the garment and one or more external contact surfaces.

It is also envisaged that the grip elements need not be arranged in continuous patterns. A garment may for example include a grip coating on a first garment section and another grip coating on a second garment section spaced from and not necessarily located immediately adjacent the first garment section.

In the case of a garment in the form of a sock or glove, the first array of grip elements may be located on an inner surface of an upper portion of the garment as well as the inner surface the palm or sole portion, and the second array of grip elements is located on an outer surface of the upper portion of the garment as well as the outer surface of the palm or sole portion.

Where such a sock is worn within a shoe, the provision of grip elements on the upper portion of a sock helps to resist movement between the wearer's foot, the sock and the shoe and thereby improve the comfort of the wearer by further preventing any unnecessary movement between the top of the shoe, sock and wearer's foot. This reduces the creation of sweat on the wearer's skin and reduces the risk of irritation that could otherwise be caused as a result.

In such embodiments, the first and second arrays of grip elements located on the upper portion and the sole or palm portion of the garment may be continuous, i.e. the first and second arrays of grip elements may extend respectively about the inner and outer surfaces of the garment, or may be discontinuous, i.e. the first and second arrays on the upper portion of the garment may be separated from the first and second arrays on the sole or palm of the garment. The exact arrangement will depend and be determined by the desired performance of the garment when it is worn.

Preferably, so as to limit relative movement in use between a wearer's skin, the garment and an external contact surface, the first and second arrays of grip elements may be arranged relative to each other so that grip elements of each of the arrays are interposed between grip elements of the other of the arrays.

This interposition of the grip elements of the first and second arrays helps to lock the garment in position relative to the wearer's skin and the external contact surface by creating a relatively equal uniform frictional effect between the wearer's skin, the garment and the external contact surface.

In such embodiments the grip elements of the first and second arrays may be provided in the form of discrete elements arranged in rows and columns, one or more rows of grip elements of each of the arrays being interposed between rows of grip elements of the other of the arrays.

It is envisaged that the discrete grip elements could be any shape. In particularly preferred embodiments however the discrete grip elements could be circular or elliptical in shape.

In other such embodiments the grip elements of the first and second arrays are elongated elements arranged in rows, one or more elongated elements of each of the arrays being interposed between elongated elements of the other of the arrays.

The elongated elements could again be any shape. They could be, for example, straight, zigzag or otherwise irregular in shape.

It is envisaged that as well as preventing irritation that might otherwise be caused by relative movement between a wearer's skin, the garment and an external contact surface, the provision of the grip elements on the inner and outer surfaces of the garment section may have a therapeutic effect. For example, by appropriate location of the grip elements, a garment according to the invention could help to improve blood flow in a part of the wearer's body such as a wearer's hand, foot, leg or arm.

In other such embodiments of the invention the grip elements may be located on the inner and outer surfaces of the sole or palm portions of the garment in correspondence with reflexology zones of a wearer's body. It will be appreciated that such an arrangement might be particularly applicable to embodiments in which the garment is provided in the form of a sock or a glove.

In order to provide grip elements on the inner and outer surfaces that create the required frictional effect and maximise wearer comfort the grip elements may be formed from a silicone material.

In such embodiments, so as to further enhance comfort and minimise relative movement between a wearer's skin, the garment and an external contact surface the silicone material may be chosen so as to present a tacky surface.

In preferred embodiments, the grip elements may be formed from silicone compounds known as Momentive® 830 or Momentive® SLR2650.

The silicone may be applied to the inner and outer surfaces of the garment section by means of printing or extruding. In either case, the silicone is applied in an uncured form and is subsequently allowed to cure under ambient conditions or by the application of heat and/or UV radiation.

In the case of printing, the silicone may be printed through a sheet of material as opposed to a mesh, the sheet of material including openings corresponding to the desired pattern of grip elements. This allows the depth of the resultant grip elements to be controlled, the depth of the resultant grip elements on the inner and outer surfaces of the garment section being controlled by controlling the depth of the sheet of material used in the printing process.

In embodiments where the garment is a sock, the wearer's comfort may be further enhanced by including additional structural component parts in the structure of the sock.

In one such embodiment the first and second arrays include grip elements may be located on inner and outer surfaces of a front section of the sole portion and grip elements located on inner and outer surfaces of a heel section of the sole portion, the grip elements on the front and heel sections being separated by a stretchable band formed in the sock so as to stretch about the arch of a wearer's foot when the sock is worn.

The provision of the stretchable band in use ensures a snug and comfortable fit of the sock about a wearer's foot and ensures there are no grip elements that might otherwise contact the arch of a wearer's skin, which is generally more sensitive and which in any event is unlikely to make contact via the sock with the inner surface of a shoe.

In other such embodiments a garment in the form of a sock may further include a knitted portion provided in the heel portion so as to provide additional padding in use about a wearer's ankle.

Other advantageous features will be apparent from the following description in which a preferred embodiment will be described with reference to the accompanying drawings in which:

DETAILED DESCRIPTION

Figure 1:
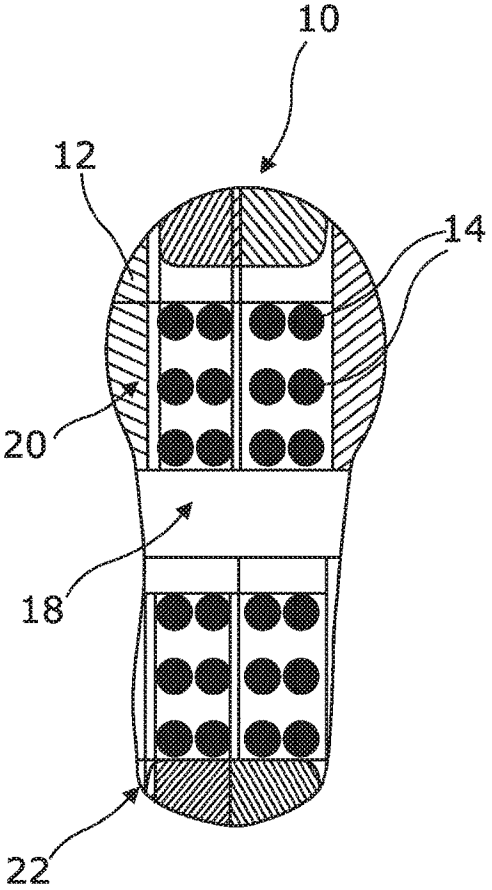
FIG. 1 illustrates a first array of grip elements on an inner surface of a sole portion of a sock according to a first embodiment of the invention.

A sock 10 according to an embodiment of the invention is shown in FIG. 1.

The sock 10 includes a sole portion 12 having a first array of grip elements 14 located on an inner surface of the sole portion 12.

In the embodiment shown in FIG. 1, the grip elements 14 are discrete elements that are circular in shape and arranged in rows and columns. In other embodiments it is envisaged that the grip elements may have a different shape. They could, for example, be provided in an ellipsoidal, square, rectangular or polyhedral shape.

Figure 2:
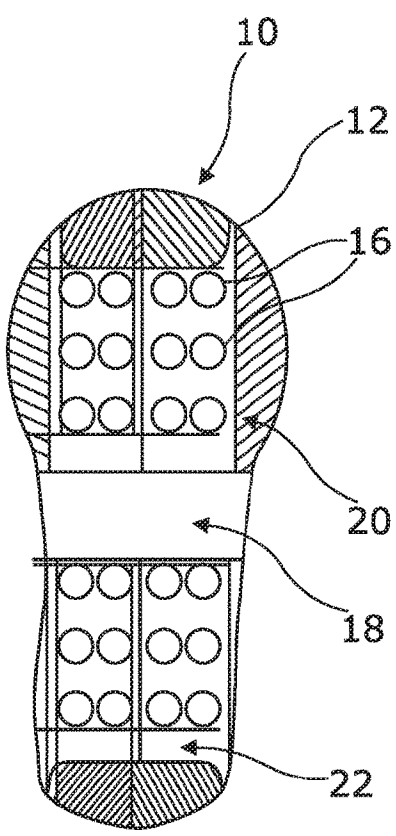
FIG. 2 illustrates a second array of grip elements on an outer surface of the sole portion of the sock shown in FIG. 1.

Referring to FIG. 2, the sock 10 also includes a second array of grip elements 16 located on an outer surface of the sole portion 12.

As with the first array of grip elements 14, grip elements 16 of the second array are circular in shape and arranged in rows and columns.

The size, shape and relative arrangement of the grip elements 16 of the second array is substantially the same as that of the grip element 14 of the first array. However, as is illustrated in FIG. 3, the first and second arrays are arranged relative to each other so that the grip elements 14,16 of the first and second arrays are offset relative to each other and do not overlie or overlap each other.

As outlined above, locating the grip elements of the first and second arrays so as to be offset relative to each other and to not overlie or overlap each other improves the level of comfort offered by the grip elements when the sock 10 is worn.

Figure 3:
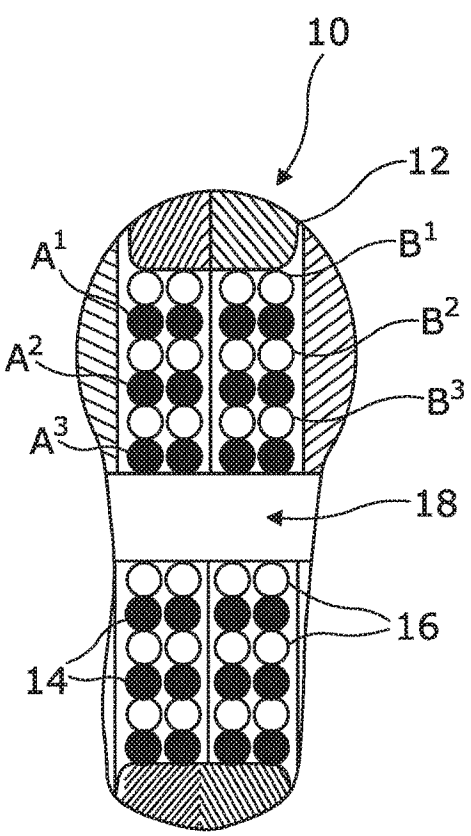
FIG. 3 illustrates the relative positions of the first and second arrays of grip elements on the sole portion of the sock shown in FIG. 1.

Referring to FIG. 3 it can be seen that the first and second arrays of grip elements 14,16 are arranged relative to each other so that rows $A^1$,$A^2$ of the first array of grip elements 14 are interposed between rows $B^1$,$B^2$,$B^3$ of the second array of grip elements 16.

Similiarly rows $B^2$,$B^3$ of the second array of grip elements 16 are interposed between rows $A^1$,$A^2$,$A^3$ of the first array of grip elements 14.

This interposition of the grip elements 14,16 of the first and second arrays helps in use to lock a wearer's foot in position relative to an external contact surface, such as the inner sole of a shoe, by creating a relatively equal uniform frictional effect between the wearer's foot, the sock 10 and the external contact surface.

So as to further improve the comfort of the wearer, the sock 10 includes a stretchable band 18 located between grip elements 14,16 located on a front section 20 of the sole portion 12 and a heel second 22 of the sole portion 12. In use the stretchable band 18 extends about the arch of a wearer's foot so as to ensure a snug and comfortable fit of the sock.

As outlined above, and illustrated in FIG. 3, the provision of the stretchable band, which is devoid of any grip elements 14,16 ensures there are no grip elements that might otherwise contact the arch of a wearer's skin, which is generally more sensitive and which in any event is unlikely to make contact via the sock with the inner sole of a shoe.

The grip elements 14,16 are preferably formed from a tacky silicone material so as to achieve the desired grip between the wearer's skin, the sock 10 and an external contact surface such as an inner sole of shoe.

It will be appreciated that the tackiness of the silicone material changes with the relative softness and viscosity of the silicone material and it will also be appreciated that the level of grip may be changed by changing the nature of the silicone material. Accordingly the grip may be specifically tailored for a particular application.

As is well known in the use of silicone materials to provide adhesive and tacky coatings on garments, additives may be incorporated into the silicone in order to provide beneficial effects. Such additives could include but are not limited to silver, colour pigment and perfume.

It will also be appreciated that whilst the embodiment illustrated in FIGS. 1-3 is limited to the provision of first and second arrays of grip elements 14,16 on the sole 12 of the sock 10, in other embodiments the first and second arrays of grip elements 14,16 may be extended so as to include grip elements 14,16 on the inner and outer surfaces of an upper portion of the sock 10 and thereby restrict relative movement between a wearer's foot, the upper portion of the sock 10 and the inner surface of a shoe.

Figure 4:
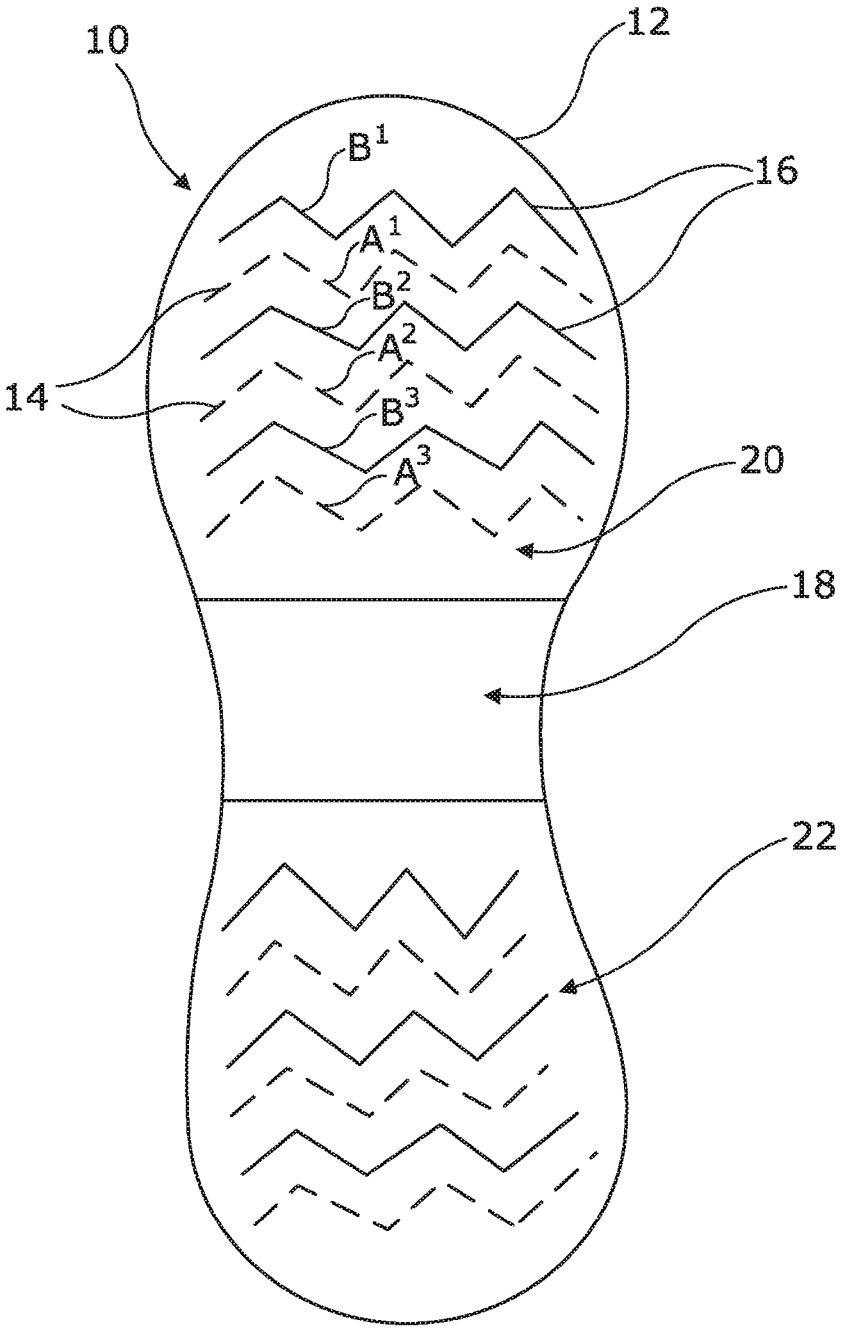
FIG. 4 illustrates the relative positions of first and second arrays of grip elements on the sole portion of a sock according to a second embodiment of the invention.

It will also be appreciated that in other embodiments the shape of the grip elements 14,16 may be changed. In one such embodiment, as is illustrated in FIG. 4, the grip elements 14,16 may be provided in the form of zigzags.

Whilst the embodiments shown in FIGS. 1-4 are limited to socks, it will be appreciated that the same arrangement of first and second arrays of grip elements 14,16 might readily be applied to the inner and outer surfaces of the palm portion of a glove.

It will also be appreciated that the same or other arrangements of first and second arrays of grip elements 14,16 might readily be applied to the inner and outer surfaces of garment sections of other items of apparel. The first and second arrays of grip elements 14,16 might, for example, be applied to inner and outer surfaces of inner arm or inner thigh sections of base layer garments or other performance garments.

In the embodiments shown in FIGS. 1-4, the grip elements 14,16 are formed from a silicone material in order to create the required frictional effect and maximise wearer comfort, the silicone material being chosen so as to present a tacky surface.

Examples of silicone materials that are suitable include Momentive® 830 and Momentive® SLR2650.

During a method of forming the grip coating on the sock 10, the silicone is applied to the inner and outer surfaces of the sole 12 in turn by means of printing. The silicone is applied in an uncured form and is subsequently allowed to cure under ambient conditions or by the application of heat and/or UV radiation.

The silicone is printed through a sheet of material as opposed to a mesh. The sheet of material including openings corresponding to the desired pattern of grip elements 14,16. This allows the depth of the resultant grip elements 14,16 to be controlled, the depth of the resultant grip elements 14,16 on the inner and outer surfaces of the sole 12 being controlled by controlling the depth of the sheet of material used in the printing process.

In other embodiments, the grip elements 14,16 may be applied by other methods. The grip elements 14,16 could for example be applied by means of extrusion.

The invention claimed is:

1. A garment comprising a grip coating located on inner and outer surfaces of a garment section so as to generate in use friction between a wearer's skin and the garment and friction between the garment and an external contact surface, the grip coating including a first array of grip elements located on the inner surface of the garment section and a second array of grip elements located on the outer surface of the garment section, the first and second arrays being arranged relative to each other so that the grip elements of the first array are offset relative to and do not overlie or overlap the grip elements of the second;

wherein the first and second arrays of grip elements are arranged relative to each other so that grip elements of each of the arrays are interposed between grip elements of the other of the arrays.

2. The garment according to claim 1, wherein the garment is a sock or glove or the like and the grip coating is located on inner and outer surfaces of sole or palm portions of the garment, the first array of grip elements being located on the inner surface of the sole or palm portion and the second array of grip elements being located on the outer surface of the sole or palm portion.

3. The garment according to claim 1, wherein the first and second arrays of grip elements extend across the inner and outer surfaces respectively of more than one garment section.

4. The garment according to claim 1, wherein the grip elements of the first and second arrays are discrete elements arranged in rows and columns, one or more rows of grip elements of each of the arrays being interposed between rows of grip elements of the other of the arrays.

5. The garment according to claim 4, wherein the grip elements are circular or elliptical in shape.

6. The garment according to claim 1, wherein the grip elements of the first and second arrays are elongated elements arranged in rows, one or more elongated elements of each of the arrays being interposed between elongated elements of the other of the arrays.

7. The garment according to claim 6, wherein the elongated elements are straight or zigzag or otherwise irregular in shape.

8. The garment according to claim 1, wherein grip elements are located on the inner and outer surfaces of the sole or palm portions of the garment in correspondence with reflexology zones of a wearer's foot or hand.

9. The garment according to claim 1, wherein the grip elements are formed from a silicone material.

10. The garment according to claim 9, wherein the silicone material is chosen so as to present a tacky surface for contact with a wearer's skin and external contact surfaces.

11. The garment according to claim 1, wherein the garment comprises a sock, wherein the first and second arrays include grip elements located on inner and outer surfaces of a front section of the sole portion and grip elements located on inner and outer surfaces of a heel section of the sole portion, the grip elements on the front and heel sections being separated by a stretchable band formed in the sock so as to stretch about the arch of a wearer's foot when the sock is worn.

12. The garment according to claim 1, wherein the garment comprises a sock, the sock further including a knitted portion provided in the heel portion so as to provide additional padding in use about a wearer's ankle.

13. A method of forming a garment according to claim 1, wherein liquid silicone is applied to one of the inner and outer surfaces of the garment section and cured or otherwise allowed to cure to form one of the first and second arrays of grip elements before applying liquid silicone to the other of the inner and outer surfaces of the garment section and curing or otherwise allow the silicone to cure to form the other of the first and second arrays of grip elements.

14. The method according to claim 13, wherein the liquid silicone is applied by means of screen printing, the screen including a sheet of material having openings corresponding to a desired pattern for the first and second arrays of grip elements.

15. The method according to claim 14 wherein the depth of each of the resultant grip elements is controlled by controlling the depth of the sheet of material used to form the screen for the screen printing process.

16. The method according to claim 13, wherein the liquid silicone is applied by means of extrusion.

17. The method according to claim 13, wherein the liquid silicone is selected from the group including Momentive® 830 and Momentive® SLR2650.

* * * * *